US008123269B2

(12) United States Patent
Zhang

(10) Patent No.: US 8,123,269 B2
(45) Date of Patent: Feb. 28, 2012

(54) LIFTING DEVICE

(75) Inventor: Binhui Zhang, Ningbo (CN)

(73) Assignee: Beifa Group Co., Ltd., Ningbo (CN)

( * ) Notice: Subject to any disclaimer, the term of this patent is extended or adjusted under 35 U.S.C. 154(b) by 134 days.

(21) Appl. No.: 12/637,651

(22) Filed: Dec. 14, 2009

(65) Prior Publication Data

US 2010/0150694 A1 Jun. 17, 2010

(30) Foreign Application Priority Data

Dec. 16, 2008 (CN) ..... 2008 2 0171355 U

(51) Int. Cl.
*A45F 5/00* (2006.01)

(52) U.S. Cl. ..... 294/165; 294/137

(58) Field of Classification Search ..... 294/137, 294/158, 165, 159, 166, 171; 24/598.1, 599.1, 24/599.4, 599.9
See application file for complete search history.

(56) References Cited

U.S. PATENT DOCUMENTS

| | | | | |
|---|---|---|---|---|
| 5,263,755 | A * | 11/1993 | Thompson | 294/165 |
| D362,386 | S | 9/1995 | Blocker | |
| D369,470 | S | 5/1996 | Suggs, Sr. | |
| D374,622 | S | 10/1996 | Winborne | |
| D386,682 | S | 11/1997 | Richardson | |
| D423,348 | S | 4/2000 | Le Roux | |
| D495,493 | S | 9/2004 | Moriarty | |
| D520,362 | S | 5/2006 | Powell | |
| 7,097,223 | B1 * | 8/2006 | Bradford | 294/137 |
| 7,322,624 | B2 * | 1/2008 | Murphy | 294/137 |
| D583,155 | S | 12/2008 | Melfi | |
| 7,533,916 | B2 | 5/2009 | Eichenbaum | |
| 2004/0212208 | A1 | 10/2004 | Link | |
| 2006/0208515 | A1 | 9/2006 | Murphy | |

* cited by examiner

*Primary Examiner* — Saul Rodriguez
*Assistant Examiner* — Gabriela Puig
(74) *Attorney, Agent, or Firm* — Christensen O'Connor Johnson Kindness PLLC

(57) ABSTRACT

A lifting device generally includes a handle portion having first and second ends and a support portion having first and second ends. The first end of the support portion is pivotably coupled to the first end of the handle portion and the second end of the support portion is releasably engageable with the second end of the handle portion, such that the lifting device may be positioned in at least a closed position and an open position.

23 Claims, 3 Drawing Sheets

LIFTING DEVICE

CROSS-REFERENCE TO RELATED APPLICATION

This application claims the priority of Chinese Patent Application No. 200820171355.7 filed Dec. 16, 2008, under 35 U.S.C. §119, the disclosure of which is hereby expressly incorporated by reference.

BACKGROUND

In their daily lives, people often use bags such as paper or plastic bags, cloth bags and so on, for example, for shopping. Normally, plastic bags or paper bags for carrying food and produce are supplied by food stores or food markets and therefore do not need to be brought by shoppers from home. Plastic bags with relatively thin handles are particularly commonly used by shoppers. Often times, shoppers use a few bags at a time in order to carry their purchases out of a store. Having loaded a number of bags with purchases, a shopper would experience an uncomfortable tension in his or her hands while carrying a few bags at a time in each hand. Furthermore, the shopper's hands might start aching and an imprint caused by the bag handles may appear on the shopper's skin. The longer the shopper carries his or her bags filled with purchases, particularly with heavy purchases, the more tense and tired his or her hand would feel.

Therefore, there is a need for a lifting device that could be used for carrying multiple bags at a time for a long time, without any inconvenience to a shopper that carrying multiple shopping bags normally causes.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a lifting device is provided. The lifting device generally includes a handle portion having first and second ends; and a support portion having first and second ends. The first end of the support portion is pivotably coupled to the first end of the handle portion and the second end of the support portion is releasably engageable with the second end of the handle portion, such that the lifting device may be positioned in at least a closed position and an open position.

In accordance with another embodiment of the present disclosure, a lifting device is provided. The lifting device generally includes a handle portion having first and second ends; and a support portion having first and second ends. The first end of the support portion is pivotably coupled to the first end of the handle portion and the second end of the support portion is releasably engageable with the second end of the handle portion, such that the lifting device may be positioned in at least a closed position and an open position. The device further includes an engagement mechanism including a lock tongue and lock hook and release portion. The lock hook and release portion includes a pull block, a button for moving the engagement mechanism to an unengaged position, and a return spring for biasing the engagement mechanism to an engaged position. Pressing the button inward releases the engagement mechanism such that the lifting device is in its open position and releasing the button returns the engagement mechanism to its open position.

In accordance with another embodiment of the present disclosure, a method of using a lifting device is provided. The method generally includes obtaining a lifting device including a handle portion having a first and second ends, and a support portion having first and second ends, wherein the first end of the support portion is pivotably coupled to the first end of the handle portion and wherein the second end of the support portion is releasably engageable with the second end of the handle portion, such that the lifting device may be positioned in at least a first closed position and a second open position. The method further includes inserting a load between the handle portion and the support portion when the lifting device is in the open position, engaging the handle portion and the support portion such that the lifting device is in the closed position; and lifting a load using the lifting device.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein.

DETAILED DESCRIPTION

Figure 1:
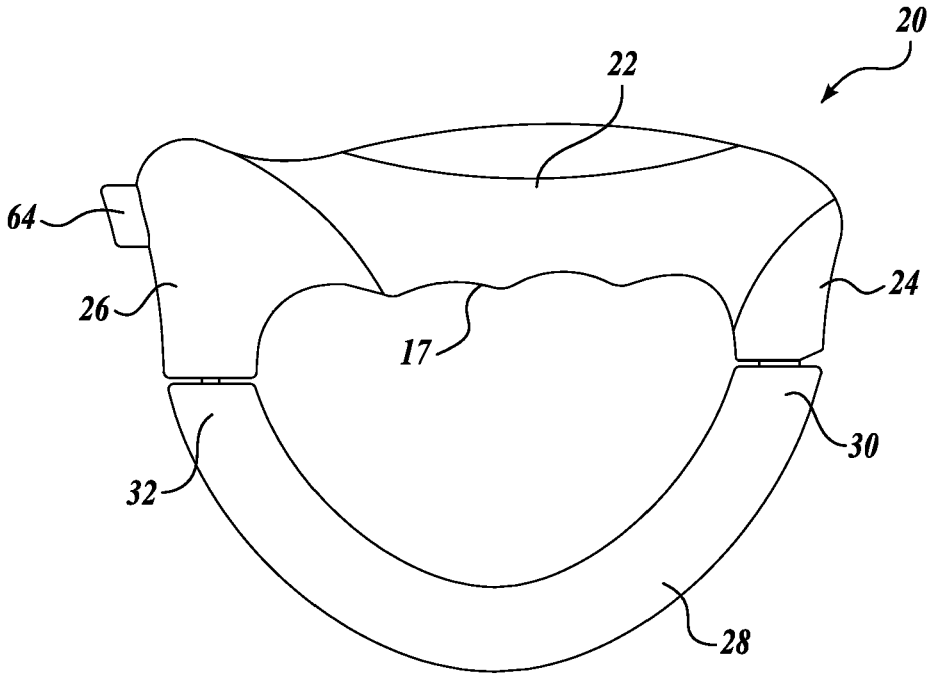
FIG. 1 is a front view of a lifting device constructed in accordance with an embodiment of the present disclosure.

A lifting device 20, according to one embodiment of the present disclosure, includes a handle portion 22 having first and second ends 24 and 26 and a support portion 28 having first and second ends 30 and 32. The first end 24 of the handle portion 22 is pivotably coupled to the first end 30 of the support portion 28. The second end 26 of the handle portion 22 is configured to releasably engage with the second end 32 of the support portion 28. The lifting device 20 is designed for a user to carry a load with ease and comfort. In that regard, handle portion 22 is designed to be held by a user, and the support portion 28 is designed to support a load to be lifted (not shown).

Figure 2:
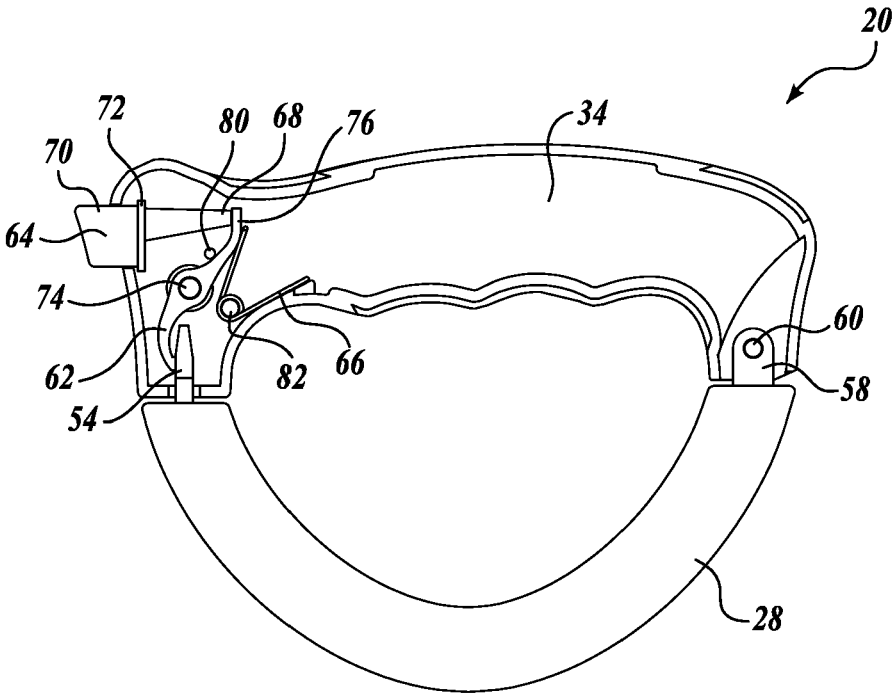
FIG. 2 is a perspective partial cross-sectional view of the internal structure of the lifting device shown in FIG. 1.
Figure 3:
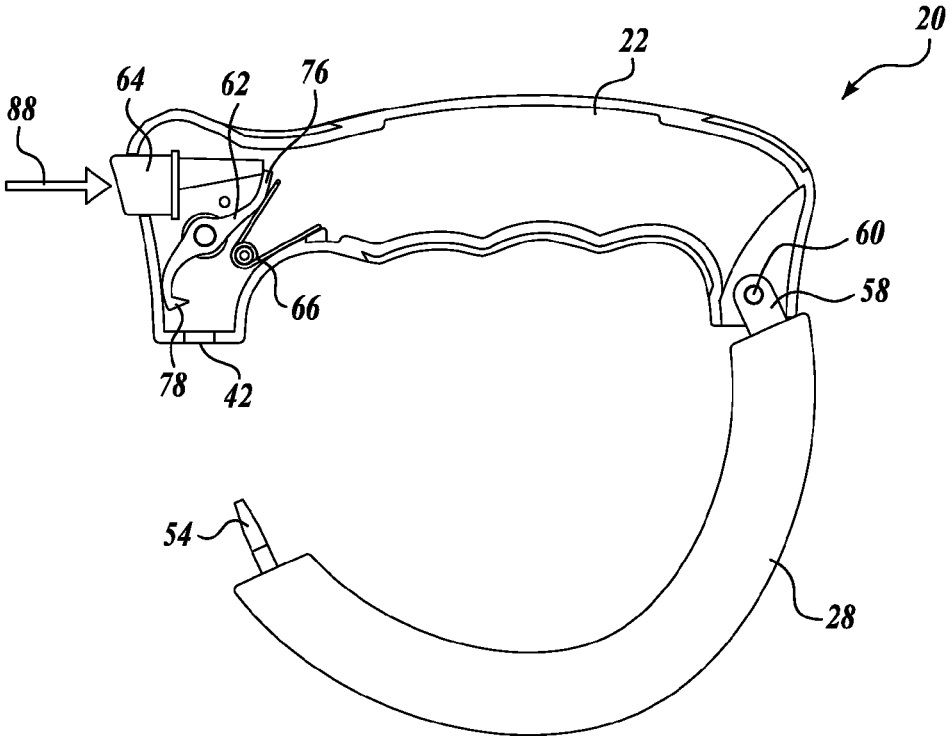
FIG. 3 is a perspective partial cross-sectional view of the internal structure of the lifting device shown in FIGS. 1 and 2 when the lifting device is in an open position.

The lifting device 20 may be positioned in at least a first closed position (see FIGS. 1 and 2) and a second open position (see FIG. 3). When in the open position, the user may insert a load between the handle portion 22 and the support portion 28, such that the load can be supported by the support portion 28. In the closed position, the user holds the handle portion 22 and carries the load supported by the support portion 28.

The handle portion is designed and configured to allow a user to carry a load with ease and comfort. In the illustrated embodiment, the handle portion is an elongated member having a rounded outer contour. Between the first and second ends, the handle portion includes a plurality of inwardly curved holding grooves 17 adapted to receive fingers or the palm of a hand. One skilled in the art will appreciate that the handle portion may take different forms suitable for a user's hand.

Figure 4:
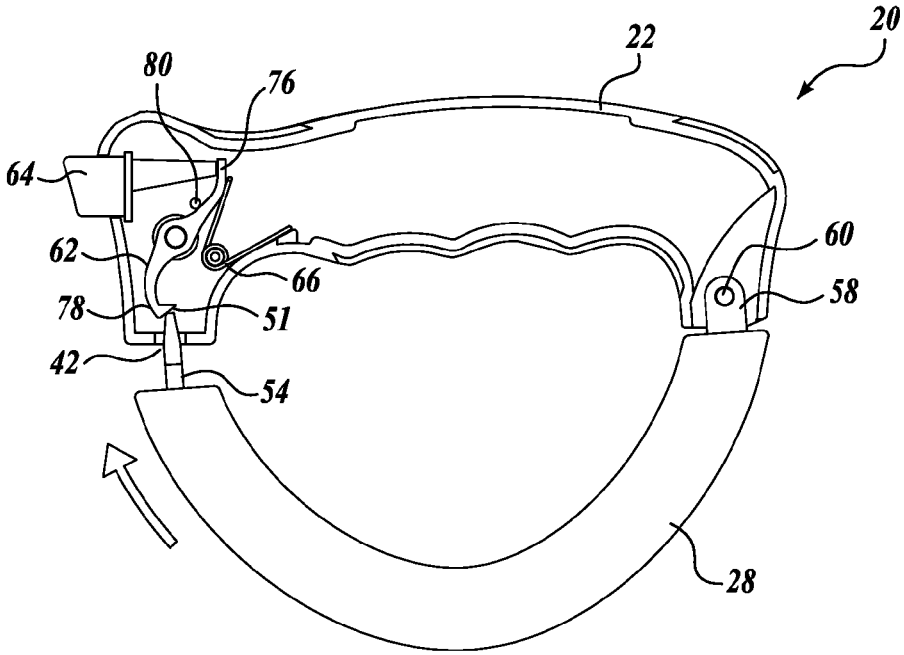
FIG. 4 is a perspective partial cross-sectional view of the internal structure of the lifting device shown in FIGS. 1 and 2 when the lifting device is being closed to a closed position.
Figure 6:
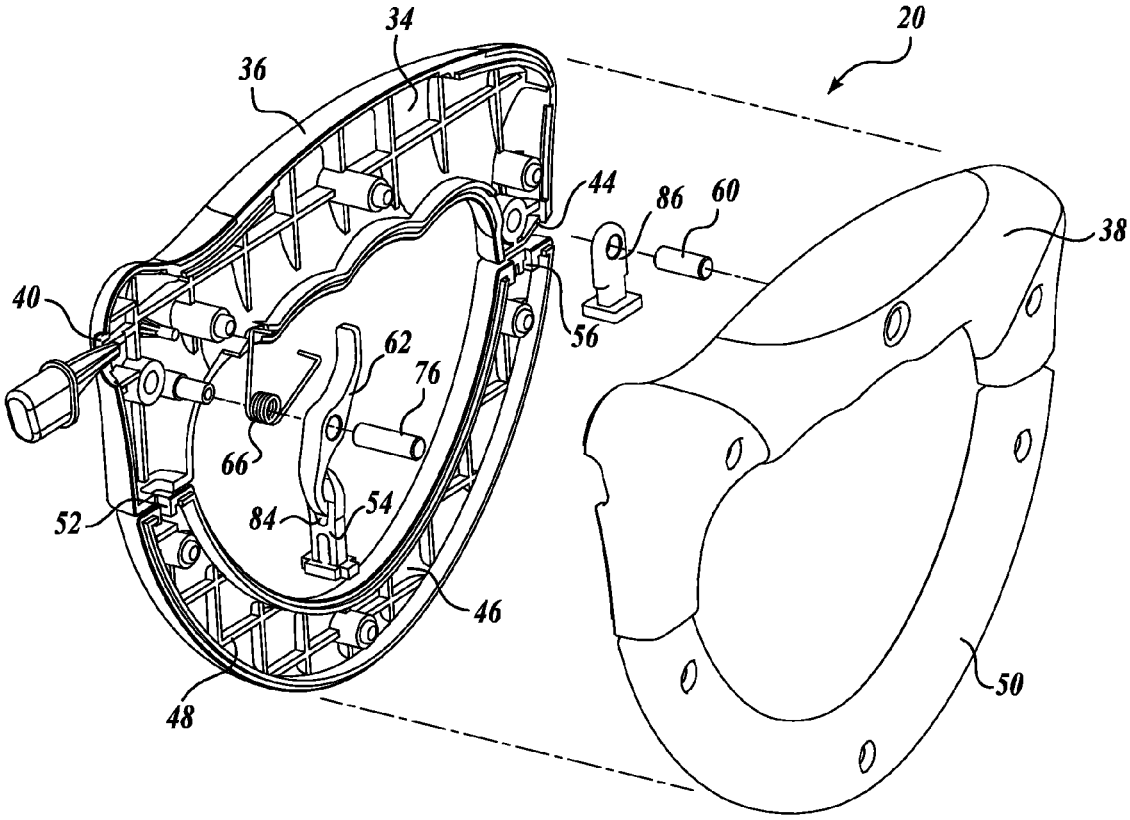
FIG. 6 is an exploded perspective view of the lifting device shown in FIGS. 1 and 2.

Referring to FIGS. 2 and 6, the handle portion further may include an inner cavity 34 for receiving various components of the lifting device 20, as described in greater detail below. In the illustrated embodiment, the handle portion 22 includes a left cover 36 and a right cover 38, which may be connected to one another to form an inner cavity 34 inside the handle portion 22. A button hole (aperture) 40 and a tongue hole (aperture) 42 are disposed on the handle portion 22, as seen in FIGS. 3, 4, and 6. The handle portion 22 further includes a hole 44 at the first end 24 for receiving the pivot device.

The support portion 28 is designed and configured to support a load, for example, one or more grocery bag handles. As such, the support portion 28 may be designed to hold the load in a secure manner when the lifting device is in the open or closed position. In the illustrated embodiment, the support portion 28 is substantially U-shaped having first and second ends 30 and 32. As other nonlimiting examples, the support portion may be substantially V-shaped, curved, squared, etc. Preferably, the shape of the support portion should facilitate the comfortable support of multiple bags when lifted using the lifting device.

Figure 5:
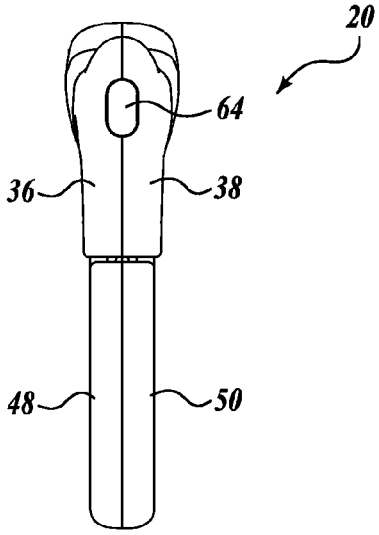
FIG. 5 is a side view of the lifting device shown in FIGS. 1 and 2.

Referring to FIGS. 5 and 6, the support portion 28, like the handle portion, may include an inner cavity 46 for receiving various components of the lifting device 20, as described in greater detail below. In the illustrated embodiment, the support portion includes a left semi-ring 48 and a right semi-ring 50, which may be connected to one another to form an inner cavity 46 inside the support portion 28. The support portion 28 further includes a hole 52 at the second end 32 from which a lock tongue 54 extends and a hole 56 at the first end 30 for mounting a pivoting device described below in greater detail.

The respective first ends 24, 30 of the handle portion 22 and the support portion 28 are configured to be coupled to one another. In that regard, at the respective first ends 24 and 30, the handle portion 22 is pivotably coupled to the support portion 28. Referring to FIG. 2, a pivoting device 58 including a pivot pin 60 is shown. However, it should be appreciated that other suitable pivoting devices are also within the scope of the present disclosure.

The advantage of a pivotal coupling is that the handle portion 22 and the support portion 28 remain coupled to one another even if the lifting device 20 is in the open position (see FIG. 3). However, it should be appreciated that a nonpivotal coupling is also within the scope of the present disclosure. For example, the lifting device 20 may include a releasable coupling, for example, such as the latch coupling at the respective second ends of the handle portion and the support portion.

The respective second ends 26 and 32 of the handle portion 22 and the support portion 28 are configured to be coupleable to one another. As mentioned above, the second end 26 of the handle portion 22 is configured to releasably engage with the second end 32 of the support portion 28. In the illustrated embodiment, the lifting device includes an engagement mechanism, such as a latch, as described in greater detail below. However, it should be appreciated that the engagement mechanism may have different implementations besides a latch known to those skilled in the art, for example, a clamping device, a lock, or the like.

The latch mechanism shown in the illustrated embodiment will now be described in greater detail. Referring to FIGS. 2-4 and 6, the latch mechanism includes a lock hook and release portion comprising a pull block 62, a button 64, and a return spring 66. The latch mechanism further includes the lock tongue 54 for engagement as described in greater detail below. Although shown as being disposed in the handle portion and support portion, the latch mechanism may be mounted in different ways known to those skilled in the art.

The button 64 includes first and second ends 68 and 70 and is disposed in the button hole 40 for reciprocal movement between a first position (see FIG. 2) and a second position (see FIG. 3). The first end 68 of the button 64 is connected with, and abutted against, the pull block 62. The second end 70 of the button 64 protrudes from the handle portion 22 through the button hole 40 so as to be accessible to the user. As seen in FIG. 2, the button may include a stop 72, preferably in a form of a loop, positioned between the first and second ends 68 and 70. It should be appreciated that the stop may be integrated with the button 64 in a number of different ways. The diameter of the stop loop 72 is preferably larger than the diameter of the button hole 40, so that the button 64 does not fall out of the button hole 40.

Still referring to FIGS. 2-4 and 6, the pull block 62 is disposed inside the inner cavity 34 of the handle portion 22 and is pivotably connected at, or proximate to, its center, to the handle portion 22 by a pivot, such as a hinge pin 74. In that regard, the pull block 62 is normally biased in a first position (see FIG. 2) but can be rotated around the hinge pin 74 in clockwise rotation to a second position (see FIG. 3), and back in counter-clockwise rotation to the first position (see FIG. 2). An upper end 76 of the pull block 62 is propped against the first end of the button 64, and the lower end of the pull block 62 forms a lock hook 78. A stop column 80 prevents the pull block 62 from rotating in counter-clockwise rotation further than the first position shown in FIG. 2.

The return spring 66 is disposed inside the handle portion 22. In one embodiment, the return spring 66 is sleeved on a spring column 82. One end of the return spring 66 is connected with and propped against the upper end 76 of the pull block 62 to bias the pull block 62 in its first position, and the other end of the return spring 66 is connected with and propped against a lower wall of the inner cavity 34. As a result of the pressure applied to the upper end 76 of the pull block 62 by the return spring 66, which props the upper end 76 of the pull block 62 to the end 68 of the button 64, the pull block 62 remains biased in the first position such that the lock hook 78 of the pull block 62 hitches the lock tongue 54.

As mentioned above, the support portion 28 includes the hole 52 at the second end 32 from which the lock tongue 54 extends. The lock tongue 54 includes a lock hole (through aperture) 84. As seen in FIGS. 2-4, the tongue hole 42 is configured to receive the lock tongue 54 enabling the lock tongue 54 to pass through the handle portion 22 and extend into the inner cavity 34, where it engages with the lock hook 78 of the pull block 62. The lock tongue 54 is engaged when the lock hook 78 engages the lock tongue aperture 84.

The pivoting device 58 shown in the illustrated embodiment will now be described in greater detail. With reference to FIG. 6, the pivoting device 58 includes the pivot pin 60 and a pin receiving portion 86. As described above, the first end 30 of the support portion 28 includes the hole 56 from which the pin receiving portion 86 extends. The first end 24 of the handle portion 22 also includes the hole 44 within which the pin receiving portion 86 is received. It should be appreciated, however, that the pin receiving portion may be housed within either the support portion or the handle portion.

When in use, the lifting device may be positioned in the open position when a user simply presses the button 64 inward, as illustrated by arrow 88 in FIG. 3. As the button 64 pushes the upper end 76 of the pull block 62 inward, compressing the return spring 66, the lower end 78 of the pull block 62 turns outward to disengage the lock hook 78 from the lock tongue aperture 84, separating the end of the support portion 28 from the handle portion 22. When the button 64 is released, the return spring 66 returns the pull block 62 to its initial position. When in the open position, a load, for example, a plurality of bags, such as plastic bags, may be hung on the support portion 28.

To position the lifting device in the closed position after the load has been hung on the support portion 28, the user pivots the support portion 28 toward the handle 22, causing the lock tongue 54 to insert into the handle portion 22 through the tongue hole 42, as illustrated in FIG. 4. The lock tongue 54 pushes the lower end 78 of the pull block 62 outward. In one embodiment, the lock hook 78 of the pull block 62 is equipped with an outer surface 51 that is adapted to slidably engage the lock tongue 54, providing a seamless movement of the lower end of the pull block 62 outward when pressed by the lock tongue 54. The elastic force of the return spring 66 will lead the pull block 62 to return when the lock hook 78 meets the lock tongue aperture 84. After this movement, the lock hook 78 is hitched in the lock tongue aperture 84, locking the support portion 28 to the handle portion 22. The user can then use the lifting device to lift the load to be carried.

While illustrative embodiments have been illustrated and described, it will be appreciated that various changes can be made therein without departing from the spirit and scope of the disclosure.

The invention claimed is:

1. A lifting device, comprising:

a handle portion having first and second ends;

a support portion having first and second ends, wherein the first end of the support portion is pivotably coupled to the first end of the handle portion and wherein the second end of the support portion is releasably engageable with the second end of the handle portion, such that the lifting device may be positioned in at least a closed position and an open position; and an engagement mechanism configured to releasably engage the second end of the handle portion with the second end of the support portion, wherein the engagement mechanism includes a lock tongue and a lock hook and release portion, wherein the lock tongue is configured to be received in engagement with the lock hook and release portion, wherein the lock tongue includes a lock tongue aperture defined therein, and wherein the lock hook and release portion includes a lock hook that extends into the lock tongue aperture when the second end of the support portion is engaged with the second end of the handle portion.

2. The lifting device of claim 1, wherein the lock tongue is disposed in the support portion and the lock hook and release portion is disposed in the handle portion.

3. The lifting device of claim 1, wherein the lock hook and release portion includes a pull block, a button for moving the engagement mechanism to an unengaged position, and a return spring for biasing the engagement mechanism to an engaged position.

4. The lifting device of claim 3, wherein the pull block is disposed inside the handle portion proximate to the second end and pivotally coupled to the handle portion, wherein an upper end of the pull block abuts the button, and a lower end of the pull block forms the lock hook.

5. The lifting device of claim 4, wherein the return spring is disposed in the handle portion body adjacent to the upper end of the pull block, wherein the engagement mechanism is normally biased in the engaged position and wherein the engagement mechanism can be biased to the unengaged position when the button is pushed.

6. The lifting device of claim 5, wherein pressing the button inward releases the engagement mechanism such that the lifting device is in its open position.

7. The lifting device of claim 6, wherein releasing the button returns the engagement mechanism to its engaged position.

8. A lifting device, comprising:

a handle portion having first and second ends;

a support portion having first and second ends, wherein the first end of the support portion is pivotably coupled to the first end of the handle portion and wherein the second end of the support portion is releasably engageable with the second end of the handle portion, such that the lifting device may be positioned in at least a closed position and an open position; and an engagement mechanism configured to releasably engage the second end of the handle portion with the second end of the support portion, wherein the engagement mechanism includes a lock tongue and a lock hook and release portion, the lock hook and release portion including a pull block, a button for moving the engagement mechanism to an unengaged position, and a return spring for biasing the engagement mechanism to an engaged position, wherein the button is disposed axially in the handle portion and has a first end protruding out of the second end of the handle portion through a button aperture, a second end disposed substantially within the handle portion, and a button stop disposed between the first and the second end.

9. The lifting device of claim 8, wherein the pull block is disposed inside the handle portion proximate to the second end and pivotally coupled to the handle portion, wherein an upper end of the pull block abuts the second end of the button, and a lower end forming a lock hook is adapted to hitch the lock tongue through a lock tongue aperture in the handle portion.

10. The lifting device of claim 9, wherein the return spring is disposed in the handle portion body adjacent to the upper end of the pull block, wherein the engagement mechanism is normally biased in the engaged position and wherein the engagement mechanism can be biased to the unengaged position when the button is pushed.

11. The lifting device of claim 10, wherein pressing the button inward releases the engagement mechanism such that the lifting device is in its open position.

12. The lifting device of claim 11, wherein releasing the button returns the engagement mechanism to its engaged position.

13. A lifting device, comprising:

a handle portion having first and second ends;

a support portion having first and second ends, wherein the first end of the support portion is pivotably coupled to the first end of the handle portion and wherein the second end of the support portion is releasably engageable with the second end of the handle portion, such that the lifting device may be positioned in at least a closed position and an open position; and an engagement mechanism including a lock tongue and lock hook and release portion, wherein the lock hook and release portion includes a pull block having a lock hook disposed inside the handle portion, a button for moving the engagement mechanism to an unengaged position in which the lock hook is disengaged from the lock tongue, and a return spring for biasing the engagement mechanism to an engaged position in which the lock hook is engageable with the lock tongue, wherein the lock hook is engageable with the lock tongue when the second end of the support portion is pivoted toward the second end of the handle portion and the lock tongue is inserted into the handle portion and brought into contact with the lock hook, and wherein pressing the button inward releases the engagement mechanism such that the lifting device can be placed in the open position and releasing the button allows the engagement mechanism to return to its engaged position such that the lifting device can be secured in the closed position.

14. The lifting device of claim 13, wherein the lock tongue is configured to be inserted through a tongue hole and engage the lock hook when the lifting device is secured in the closed position.

15. The lifting device of claim 14, wherein the lock tongue has a lock tongue aperture defined therein, and wherein the lock hook extends into the lock tongue aperture when the lock tongue engages the lock hook.

16. The lifting device of claim 14, wherein the lock tongue is configured to engage the pull block and push a lower end of the pull block outward when the lock tongue is inserted through the tongue hole.

17. The lifting device of claim 16, wherein the lock hook of the pull block has an outer surface that is adapted to slidably engage the lock tongue when the lock tongue is inserted through the tongue hole.

18. The lifting device of claim 17, wherein when the lock hook meets the lock tongue aperture, an elastic force of the return spring causes the pull block to hitch the lock hook in the lock tongue aperture and secure the lifting device in the closed position.

19. The lifting device of claim 13, wherein the lock hook is disposed inside the handle portion proximate to the second end and is pivotally coupled to the handle portion, and wherein an upper end of the pull block abuts the button and a lower end of the pull block forms the lock hook.

20. The lifting device of claim 19, wherein the return spring is disposed in the handle portion body adjacent to the upper end of the pull block, wherein the engagement mechanism is normally biased in the engaged position, and wherein the engagement mechanism can be biased to the unengaged position when the button is pushed.

21. The lifting device of claim 20, wherein pressing the button inward releases the engagement mechanism such that the lifting device is in its open position.

22. The lifting device of claim 21, wherein releasing the button returns the engagement mechanism to its engaged position.

23. The lifting device of claim 13, wherein the lock tongue is disposed in the support portion and the lock hook and release portion is disposed in the handle portion.

* * * * *